US008206015B2

(12) United States Patent
Cho et al.

(10) Patent No.: US 8,206,015 B2
(45) Date of Patent: Jun. 26, 2012

(54) LIGHT EMITTING DIODE BASED LAMP

(75) Inventors: Hankyu Cho, Seoul (KR); Dongki Paik, Seoul (KR); Euna Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/099,890

(22) Filed: May 3, 2011

(65) Prior Publication Data

US 2012/0002424 A1 Jan. 5, 2012

(30) Foreign Application Priority Data

Jul. 2, 2010 (KR) ..... 10-2010-0063728

(51) Int. Cl.
*F21V 3/04* (2006.01)
*F21V 5/02* (2006.01)

(52) U.S. Cl. ..... 362/311.02; 362/237; 362/244; 362/294; 362/335; 362/249.02

(58) Field of Classification Search ..... 362/249.02, 362/294, 373, 309, 237, 244, 311.01, 311.02, 362/335, 336
See application file for complete search history.

(56) References Cited

U.S. PATENT DOCUMENTS

| | | | | |
|---|---|---|---|---|
| 6,331,063 | B1 * | 12/2001 | Kamada et al. | 362/237 |
| 6,367,949 | B1 * | 4/2002 | Pederson | 362/240 |
| 7,322,718 | B2 | 1/2008 | Setomoto et al. | |
| 7,686,486 | B2 | 3/2010 | Tessnow et al. | |
| 7,780,317 | B2 * | 8/2010 | Schroll et al. | 362/309 |
| 2002/0024822 | A1 | 2/2002 | Pond et al. | |
| 2008/0123331 | A1 | 5/2008 | Schroll et al. | |
| 2010/0214788 | A1 * | 8/2010 | Kadono et al. | 362/311.01 |

FOREIGN PATENT DOCUMENTS

| | | |
|---|---|---|
| JP | 2004-179048 | 6/2004 |
| JP | 2006-48165 | 2/2006 |
| JP | 2009-048994 | 3/2009 |
| KR | 20-0353040 | 6/2004 |
| KR | 10-2006-0104501 | 10/2006 |
| KR | 10-0695542 | 3/2007 |
| KR | 10-2007-0044022 | 4/2007 |
| KR | 10-0715039 | 5/2007 |
| KR | 2008-0020614 | 3/2008 |
| KR | 20-2008-0002564 | 7/2008 |
| KR | 10-2009-0004569 | 1/2009 |
| KR | 10-0896381 | 4/2009 |

(Continued)

OTHER PUBLICATIONS

Korean Prior Art Search Report for Application 10-2010-0062951 dated Mar. 31, 2011.

(Continued)

*Primary Examiner* — Stephen F Husar
*Assistant Examiner* — James Cranson, Jr.
(74) *Attorney, Agent, or Firm* — KED & Associates, LLP

(57) ABSTRACT

A light emitting diode (LED) based lamp may include a LED module having at least one LED to provide light, a housing to house the LED module, and a lens to receive the light from the LED and to direct the light in a specific direction. A microlens array may have a plurality of microlenses with a polygonal shape, and a distance between two opposing sides of one of the microlens is 0.7 mm to 1.2 mm.

20 Claims, 10 Drawing Sheets

FOREIGN PATENT DOCUMENTS

| | | |
|---|---|---|
| KR | 20-2009-0004396 | 5/2009 |
| KR | 2009-0097055 | 9/2009 |
| KR | 20-0447377 | 1/2010 |
| KR | 10-2010-0026422 | 3/2010 |
| KR | 10-2010-0030683 | 3/2010 |
| KR | 10-2010-0055320 | 5/2010 |
| KR | 10-2010-006685 | 6/2010 |
| KR | 10-2010-0064800 | 6/2010 |
| KR | 10-2010-0066685 | 6/2010 |
| KR | 10-0967946 | 7/2010 |
| KR | 10-2011-0029915 | 3/2011 |
| WO | WO 2009/065389 | 5/2009 |

OTHER PUBLICATIONS

Korean Office Action for Application 10-2010-0062951 dated Apr. 22, 2011.

Korean Office Action for Application 10-2010-0059559 dated Apr. 15, 2011.

Korean Prior Art Search Report for Application 10-2010-0059559 dated Mar. 30, 2011.

Korean Prior Art Search Report for Application 10-2010-0063728 dated Mar. 31, 2011.

Korean Notice of Allowance for Application 10-2010-0059559 dated Jul. 11, 2011.

Korean Notice of Allowance for Application 10-2010-0062951 dated Jul. 28, 2011.

Office Action dated Mar. 22, 2012 for U.S. Appl. No. 13/016,310.

* cited by examiner

LIGHT EMITTING DIODE BASED LAMP

CROSS-REFERENCE TO RELATED APPLICATION

This application claims priority from Korean Application 10-2010-0063728 filed Jul. 2, 2010, the subject matter of which is incorporated herein by reference.

BACKGROUND

1. Field

Embodiments of the present invention may relate to a light emitting diode (LED) based lamp.

2. Background

An incandescent lamp, a halogen lamp, a discharge lamp and/or the like have been used as a lamp. A Light Emitting Diode (LED) has also been used. LED based lamps may use an LED member as a light source. The LED member may emit a light as minority carriers injected, by using a semiconductor P-N junction structure, are generated and re-coupled again. Light from the LED member may have a wavelength that varies with kinds of impurities added thereto, thereby enabling the LED member to emit a red color, a blue color, and/or a yellow color, and to produce a white color by an appropriate combination of the colors. The LED member may be advantageous in that the LED member may have a smaller size, a longer lifetime, a better efficiency, and/or a faster response than a light source such as the incandescent lamp, and/or the halogen lamp.

If an LED based lamp is used merely for lighting, then a direction of the light may be offset by using a non-transparent diffusion cap. If the direction of the light is required for a particular purpose, a lens structure may guide the light from the LED member in a particular direction.

The LED based lamp having a directional light may have a lens unit (or lens) or a combination of a lens unit and a reflector. By using the lens unit and the reflector, light from the LED member may have a direction that is incident on a desired region.

A combination of a plurality of microlens, (i.e., a microlens array (MLA)) may be provided on a surface of the lens (i.e., on a light emission surface). The microlens array may obtain a desired light distribution, and enhance Center Beam Candle Power (CBCP). The microlens array may also collect the light once more, which may not have been properly collected at the lens unit.

FIG. 1 shows that a microlens in a microlens array may be semi-spherical. The microlens array may have problems. As shown in FIG. 2, it may be difficult for the microlens array to avoid distortion of light distribution. As shown in FIG. 3, it may be difficult for the microlens array to avoid formation of a yellow ring YR in which a portion of emitted light may look (or appear) yellow.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made in detail to specific embodiments, examples of which may be illustrated in the accompanying drawings. Wherever possible, same reference numbers may be used throughout the drawings to refer to the same or like parts. The LED based lamp described below may be exemplary, and embodiments of the present invention may be applicable to other types of LED based lamps.

Figure 1:
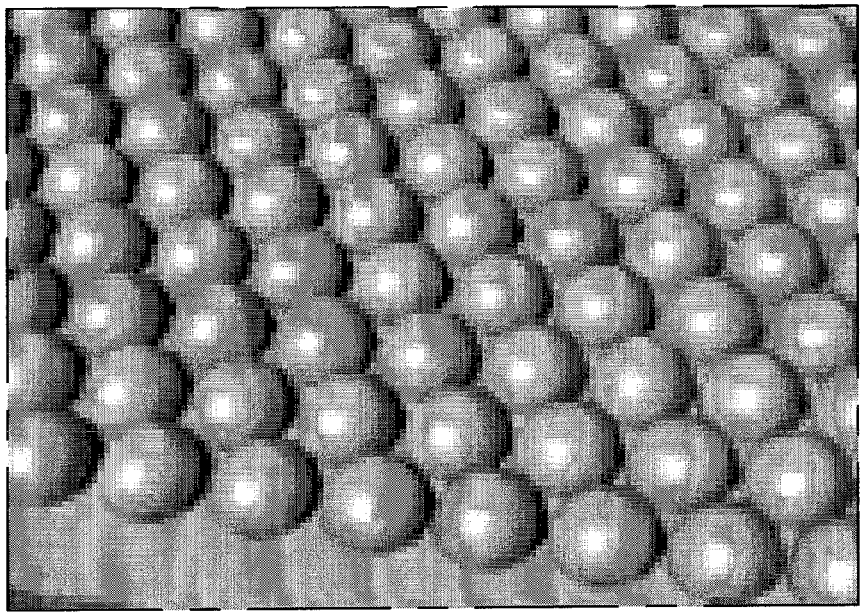
FIG. 1 illustrates a microlens array in an LED based lamp according to one arrangement.
Figure 2:
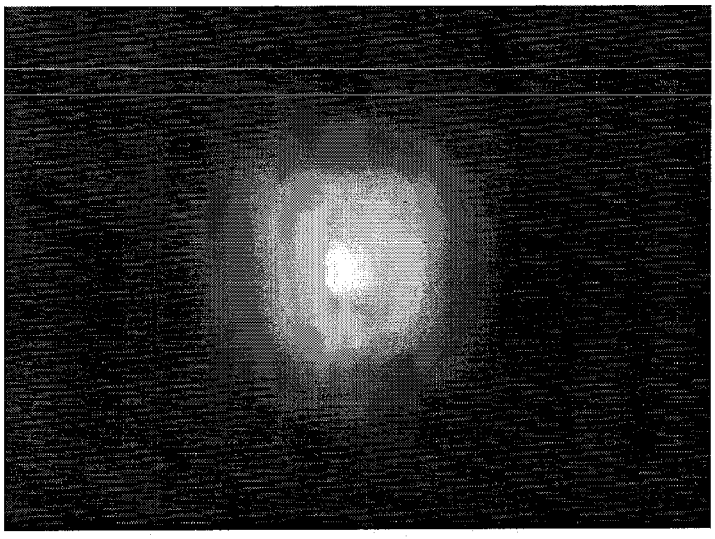
FIG. 2 illustrates a light distribution of the LED based lamp in FIG. 1.
Figure 2:
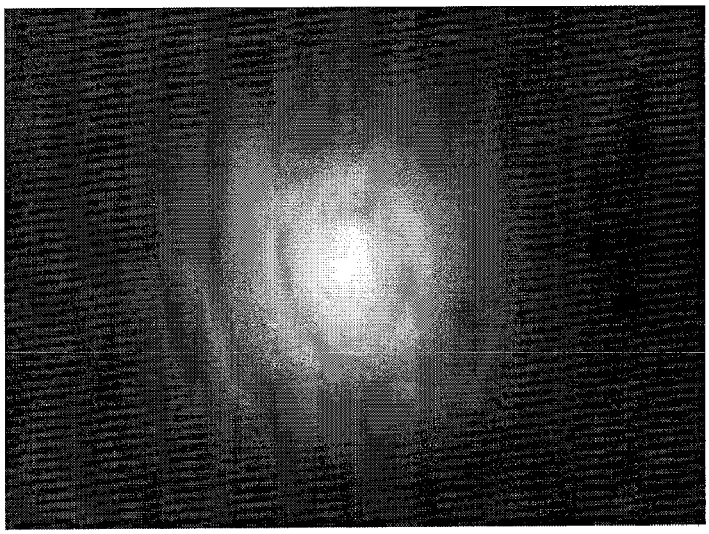
Figure 3:
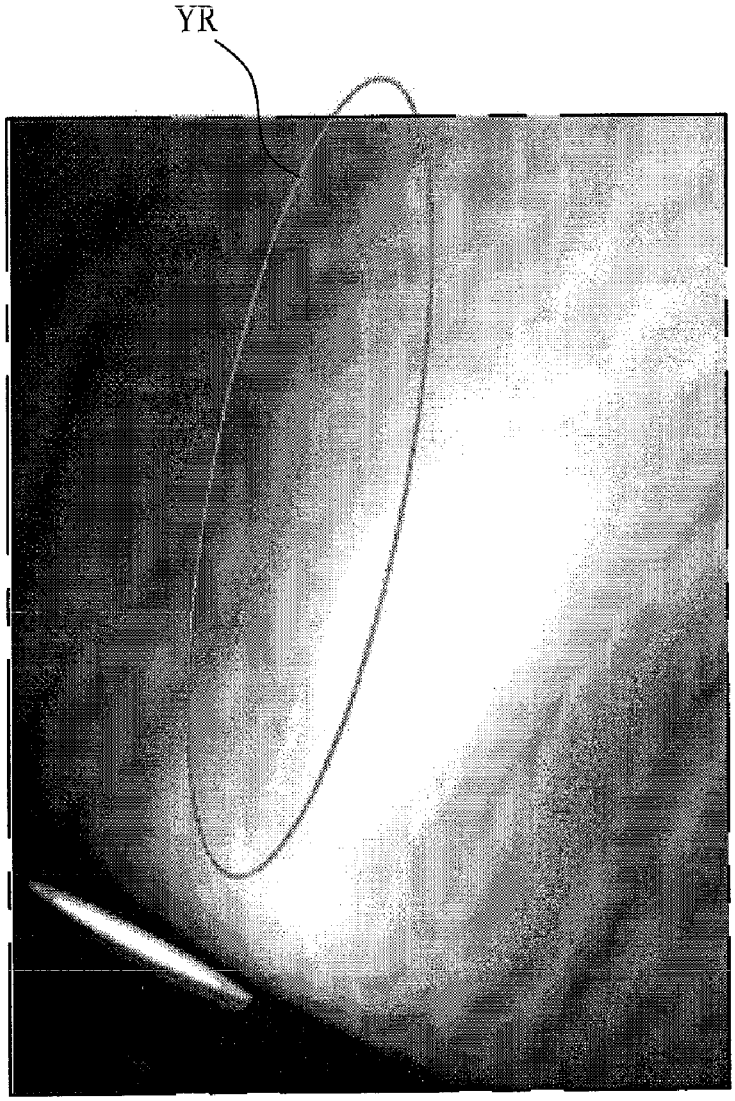
FIG. 3 illustrates a yellow ring appearing at the LED based lamp in FIG. 1.
Figure 4:
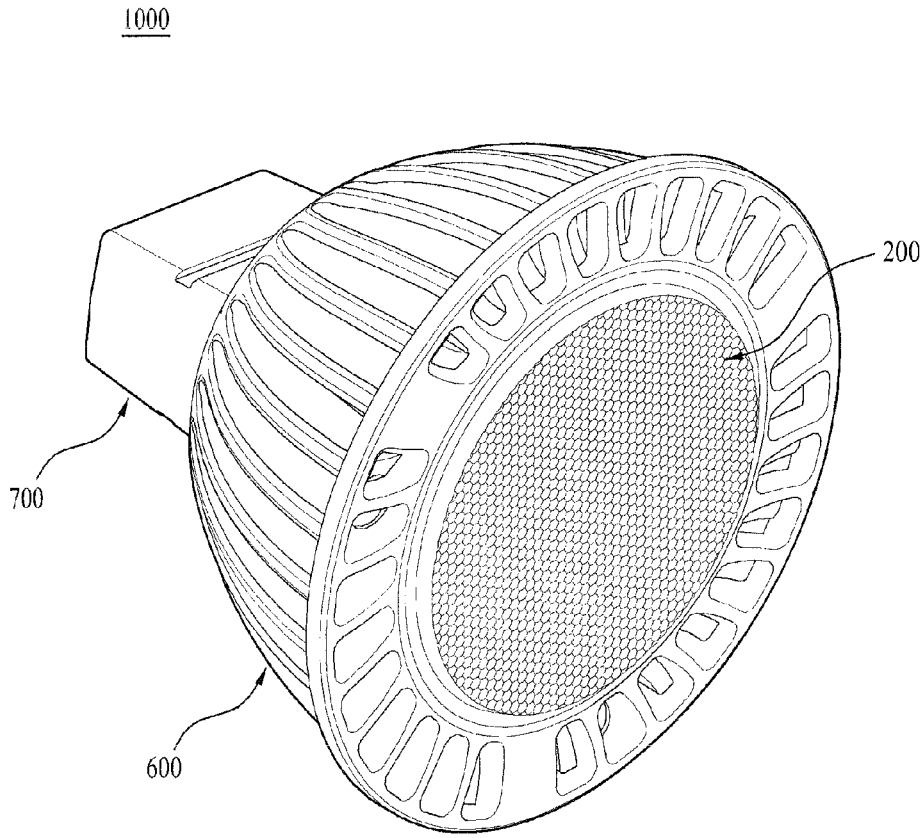
FIG. 4 illustrates a view of an LED based lamp in accordance with an example embodiment of the present invention.
Figure 5:
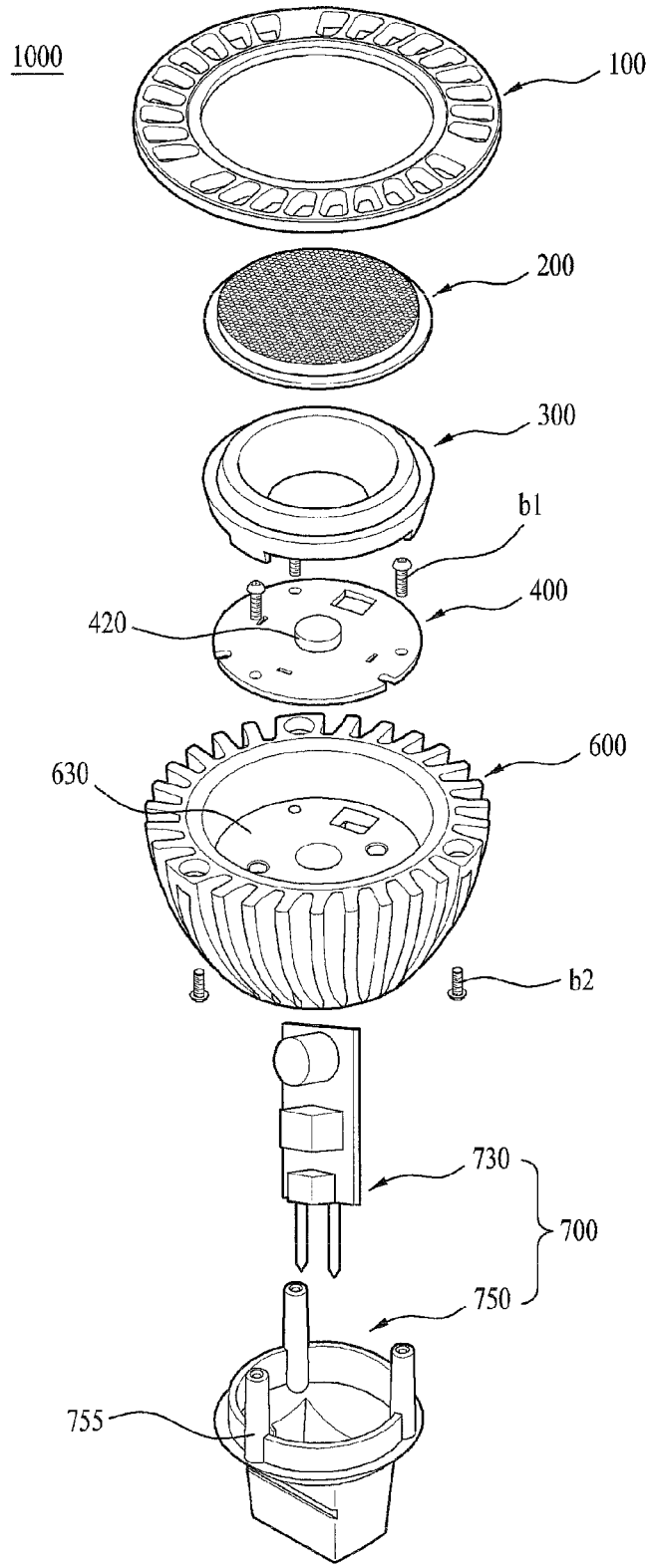
FIG. 5 illustrates an exploded view of FIG. 4.

FIGS. 4-5 show an overall configuration of an LED based lamp in accordance with an example embodiment. Other embodiments and configurations are also within the scope of embodiments of the present invention.

FIG. 4 shows an LED based lamp 1000 that includes a housing 600 (or heat sink), a lens unit 200, and a base 700. The lens unit 200 (or lens) may be provided in front of the housing 600 where an LED module 400 is provided thereto. The lens unit 200 may induce a light from the LED module 400 to be directed to a predetermined light incident region at a predetermined light incident angle. A base 700 may be provided in rear of the housing 600. The base 700 may have an electric unit for supplying power to the LED module 400, and for transmitting a control signal to the LED module 400.

The LED module 400 may have an LED 420 (or LED member) that generates heat during operation. The LED module 400 may be mounted in the housing 600. The housing 600 may have a receiving part 630 of a predetermined shape. The LED module 400 may be provided in the receiving part 630 with a fastening member, such as a bolt b1. In order to effectively dissipate heat from the LED module 400, the housing 600 may be formed of metal. Heat dissipation fins (or cooling fins) may be provided on an outside surface of the housing 600.

The lens unit 200 may be provided in front of the LED module 400 (i.e., an upper side of FIG. 5). The lens unit 200 may induce the light from the LED 420 to be directed to a predetermined light incident region. The lens unit 200 may use a total reflection for directing the light to a desired light incident region. A plastic lens, having a roughness of a few tens of nanometers to a few hundreds of nanometers, may not make total reflection of the light from the LED 420, but rather may transmit a portion thereof. Consequently, a reflector 300 may surround an outside of the lens unit 200 for re-reflecting a small quantity of the light partially transmitted. The lens unit 200 and the reflector 300 may be coupled to the housing 600 with a covering 100.

The base 700 may be coupled to a rear of the housing 600 (i.e., a lower side of FIG. 5). The base 700 may include an electric unit 730 for transforming external power to a power to be used for the LED module 400, and a housing 750 for housing the electric unit 730. The LED module 400 may use AC or DC power, and/or various magnitudes of voltages. Therefore, an AC-DC converter for converting current, and a transformer for regulating a magnitude of the voltage may be provided in the electric unit 730. The housing 750 may have fastening bosses 755 for coupling the housing 600 to the housing 750 by fastening the fastening bosses 755 to the housing 600 with bolts b2, respectively.

Figure 6:
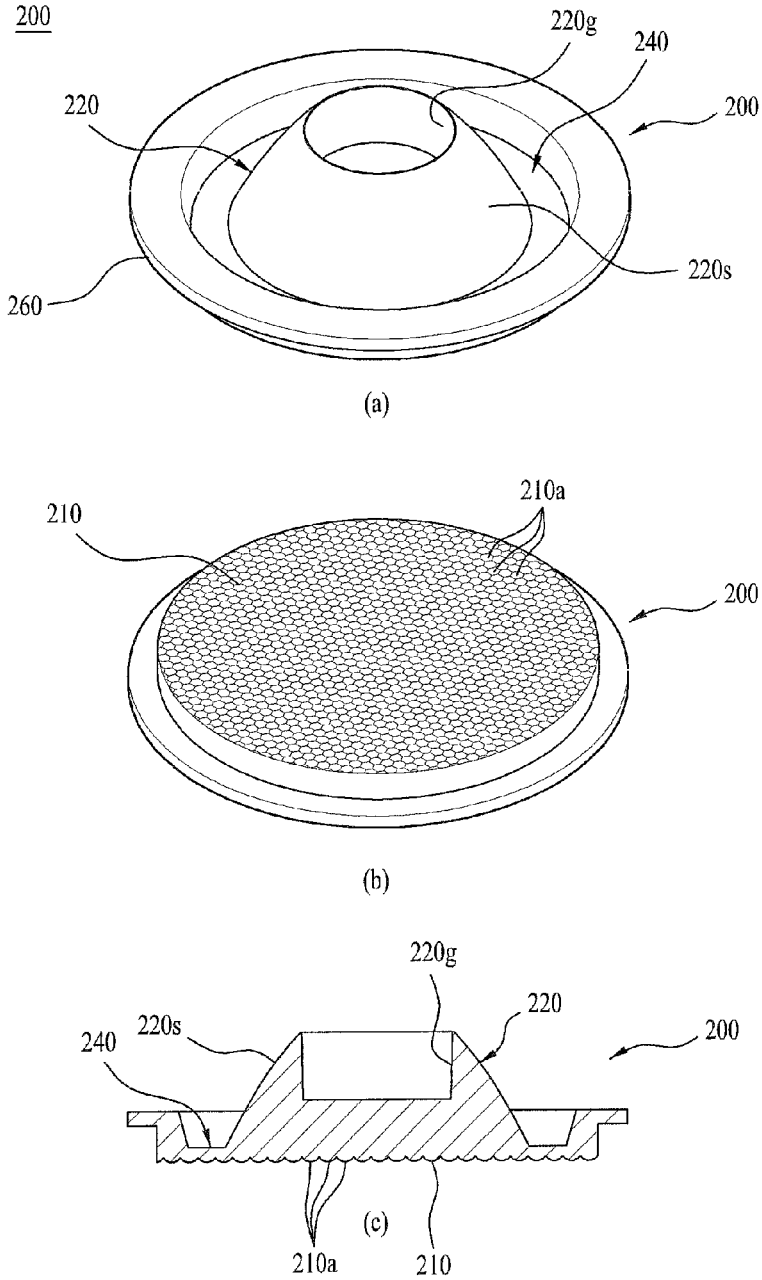
FIGS. 6(*a*), 6(*b*), and 6(*c*) illustrate a rear side view, a front side view, and a sectional view of the lens unit in FIG. 4, respectively.

The lens unit 200 may be described with reference to FIG. 6. FIG. 6(*a*) illustrates a rear side view of the lens unit 200, FIG. 6(*b*) illustrates a front side view of the lens unit 200, and FIG. 6(*c*) illustrates a sectional view of the lens unit 200.

The lens unit 200 may include a lens 220 for receiving light from the LED 420 and for guiding the light to a specific area. The lens unit 200 may also include a window 240 (or part) that is an outward extension from a circumference of the lens 220.

The lens 220 may project toward the LED module 400. The lens 220 may have a hollow part 220*g* for providing (or receiving) the LED 420 therein, and an outside surface that is a sloped surface 220*s* with a predetermined curvature for making a total reflection of the light. A front surface of the lens unit 200 may be a light emission surface 210. The light emission surface 210 may have a microlens array 210*a*. The microlens array 210*a* may be a plurality of micron sized lenses (or microlenses) provided to the light emission surface 210. The microlens array 210*a* provided to the light emission surface 210 may increase light distribution efficiency and improve a quality of emitted light.

The LED 420 of the LED module 400 may have the hollow part 220*g* provided therein, for making the light from the LED 420 to be incident on the hollow part 220*g*. The light incident on the hollow part 220*g* may be totally reflected at the sloped surface 220*s* so as to be directed to the light emission surface 210. That is, the total reflection at the sloped surface 220*s* may make the light from the LED 420 to be directed to a desired light incident region. However, since the total reflection of the entire light may actually be difficult, the reflector 300 may be used for surrounding an outside of the lens unit 200.

Since the window 240 is not a region on which the light from the LED 420 is directly incident, the window 240 may not have any particular lens function. The window 240 may be a part used for entire sizes of the lens unit 200 and may be standardized for convenience of assembly. However, light transmitted through the lens 220 and irregularly reflected at or scattered from the reflector 300 may be incident on the window 420.

The microlens array 210*a* may obtain a desired light distribution. However, when a size of the microlens is great, then it may be difficult to avoid distortion of the light distribution and the yellow ring phenomenon. Therefore, a unit size of a microlens may increase concentration. However, when the size of the semispherical unit microlens is reduced, a gap between adjacent microlenses may become greater to cause a light loss. Point to point contact between adjacent semispherical microlenses may inevitably form a gap between the adjacent semispherical microlenses, which may become larger as a size (a diameter) of the microlens becomes smaller.

Figure 7:
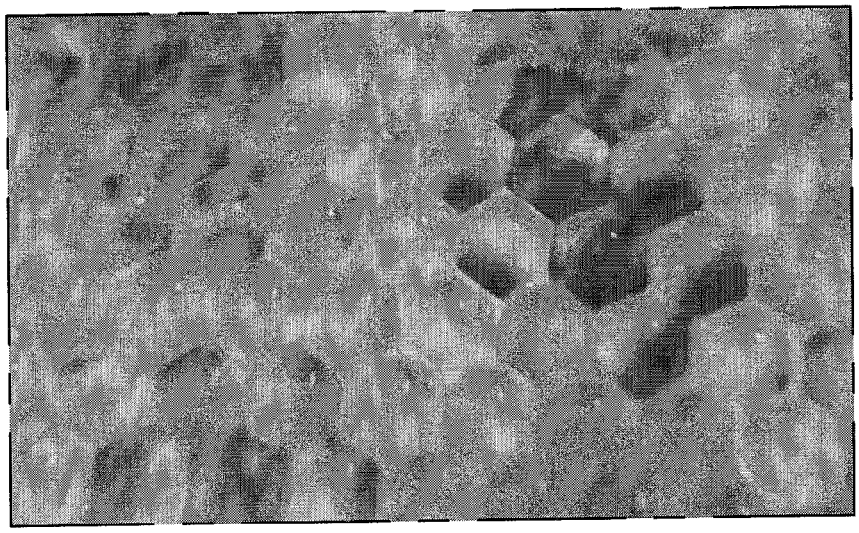
FIG. 7 illustrates the microlens array in FIG. 6.

Therefore, a shape of the microlens (or a unit size) may reduce or eliminate a gap between adjacent microlenses. As shown in FIG. 7, hexagonal dome shaped microlenses may enable adjacent microlenses to be in contact with each other, such as in line to line contact, and without forming a gap. Accordingly, even when a size of the hexagonal dome shaped microlens is reduced, loss of light may not occur based on an increased gap area, thereby reducing the yellow ring phenomenon.

In at least one embodiment, the microlenses may have a polygonal (or non-circular) shape. In at least one embodiment, at least one of the microlenses may have a hexagonal shape. In at least one embodiment, at least one of the microlenses has a hexagonal dome shape. The microlenses may be shaped to minimize a gap between adjacent microlenses. Further, shapes of different ones of the microlenses are different than shapes of other ones of the microlenses. The microlens may prevent a wavelength of the light (provided from the LED) from changing as the light is transmitted through the lens.

Figure 8:
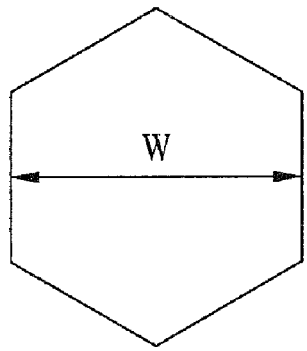
FIG. 8 illustrates a view of an exemplary shape of the microlens unit in FIG. 6.

A unit size of the microlens (or unit micorlens) may be determined appropriately by experiment or simulation within a range in which an original function of the microlens may not be harmed while preventing (or reducing) the yellow ring phenomenon from taking place. For example, the unit size of a microlens may be determined to minimize or eliminate a difference of paths of the light. As a result of study/experiment, a unit size (W shown in FIG. 8) of the microlens may be less than approximately 1.2 mm. The unit size W may also be in a range of approximately 0.7 mm-1.2 mm. That is, a distance between two opposing sides of each of the microlenses may be 0.7 mm to 1.2 mm. The unit size of the microlens may become smaller as the yellow ring phenomenon becomes more intense. For example, the unit size of the microlens may be 1.2 mm when the microlens is for a warm white lamp. However, the unit size of the microlens may be even smaller, for example approximately 0.7 mm, when the microlens for a cold white lamp for eliminating difference of paths of the light as the yellow ring phenomenon is more intense.

Even though the above embodiments are described with respect to hexagonal dome shaped microlens, embodiments of the present invention are not limited to this, as other shapes of the unit microlens may reduce the gap between adjacent microlenses by making adjacent microlenses to be in, not point to point contact, but rather line to line contact, for example. As one example, a polygonal unit microlens may be used. Embodiments of the present invention are not limited to hexagonal unit microlens.

The above-described embodiment(s) may suggest having the hexagonal dome shaped microlenses as the microlens array 210*a*, although embodiments are not limited to this embodiment(s). For example, other parts may provide a bad effect to light distribution and/or related to the yellow ring phenomenon by using experiment or simulation, and a shape of the microlens part may change. That is, of the plurality of microlenses, a shape of the microlenses at a predetermined part may change to a desired shape, for an example, to the hexagonal dome shape. That is, of the plurality of microlenses, only a shape of the microlenses at a predetermined part may be made different from the shape of the microlenses at the other part.

Figure 9:
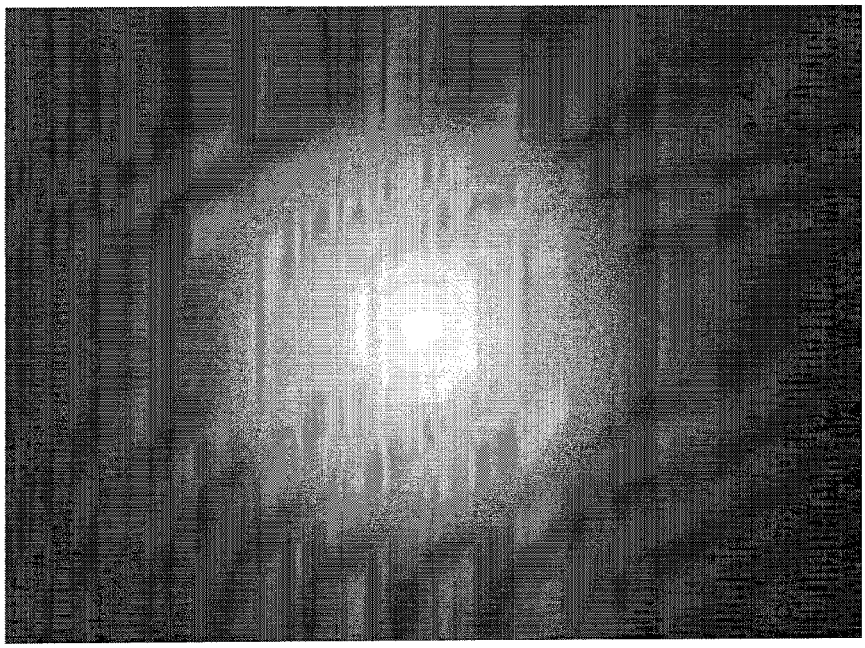
FIG. 9 illustrates a light distribution of an LED based lamp according to an example embodiment of the present invention.
Figure 10:
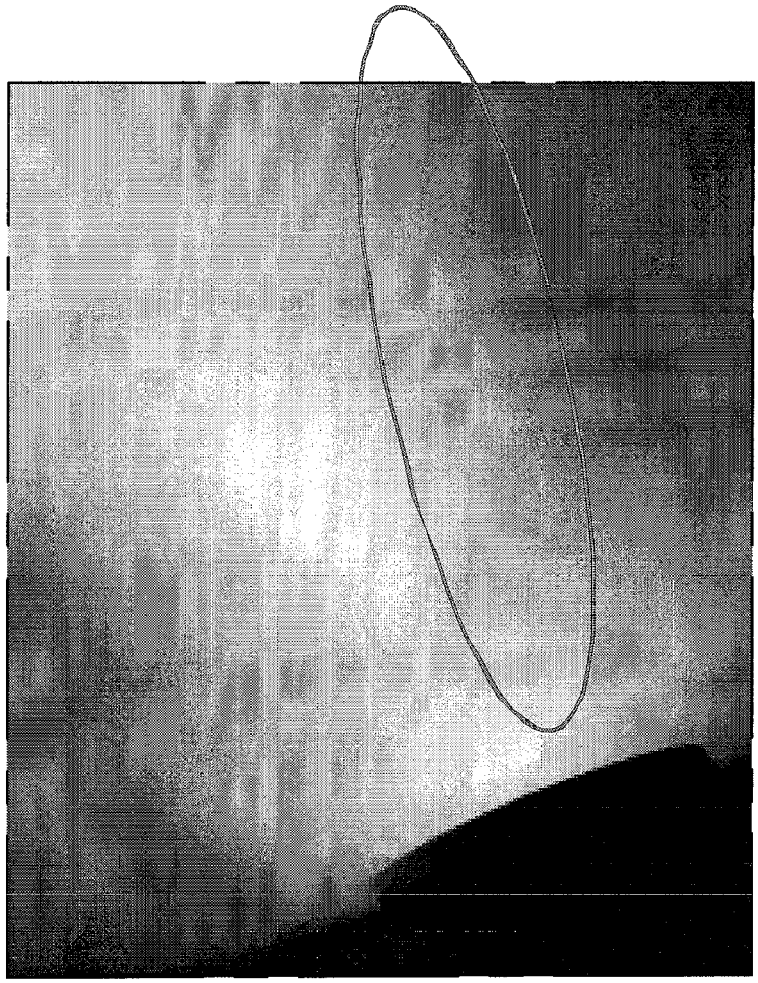
FIG. 10 illustrates a light emission from an LED based lamp according to an example embodiment of the present invention.

Operation of the LED based lamp in accordance with an example embodiment may be described with reference to FIGS. 9 and 10. As shown in FIG. 9, the LED based lamp may prevent light distribution from distorting. As shown in FIG. 10, embodiments of the LED based lamp may prevent the yellow ring phenomenon from taking place.

The LED based lamp and method for manufacturing the same of the present invention may have advantages, such as a light collecting effect may be enhanced to improve light distribution, and a yellow ring phenomenon may be prevented (or reduced).

Embodiments of the present invention may be directed to an LED based lamp.

Embodiments of the present invention may provide an LED based lamp that may improve a light distribution.

Embodiments of the present invention may provide an LED based lamp that can prevent (or reduce) a yellow ring phenomenon from taking place.

An LED based lamp may include an LED module having an LED, a housing (or a heat sink) having the LED module provided thereto, a lens unit (or lens) for inducing a light from the LED module to a defined light incident region, and a microlens array provided to the lens unit and having a plurality of microlenses. The microlens may have a shape that can eliminate or reduce a gap between adjacent microlenses for preventing a yellow ring from taking place. A shape of the microlens at a predetermined part may be different from a shape of the microlens at another part.

The microlenses may be in line to line contact to each other. The microlens may have a shape of a polygon. The microlens may also have a hexagonal dome shape.

The microlens may be size below a predetermined size. The microlens may have a size less than 1.2 mm. The microlens may also have a size of 0.7 mm-1.2 mm.

A method may also be provided for manufacturing an LED based lamp that includes a lens unit (or lens) having a microlens array with a plurality of microlenses. This may include determining a shape of the microlens, which may eliminate a gap between adjacent microlenses for preventing a yellow ring from taking place. The method may further include determining a size of the microlens to eliminate a difference of light paths. In determining a shape of the microlens, a shape of the microlens at a predetermined part can be determined to be different from a shape of the microlens at the other part.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light emitting diode (LED) based lamp comprising:

a housing;

a LED module having at least one LED to provide light, the LED module provided in the housing; and a lens to receive the light from the LED and to guide the light in a specific direction, the lens to receive the at least one LED, the lens including a light entrance surface to receive the light from the LED and a light exit surface for the light to exit from the lens, and the lens including a microlens array having a plurality of microlenses provided on the light exit surface of the lens, the microlenses having a polygonal shape, wherein a distance between two opposing sides of one of the microlenses is 0.7 mm to 1.2 mm.

2. The LED based lamp of claim 1, wherein at least one of the plurality of microlenses has a hexagonal shape.

3. The LED based lamp of claim 1, wherein at least one of the plurality of microlenses has a hexagonal dome shape.

4. The LED based lamp of claim 1, wherein a shape of a first one of the microlens is different from a shape of a second one of the microlens.

5. The LED based lamp of claim 1, wherein at least three of the microlenses are in line to line contact.

6. The LED based lamp of claim 1, wherein the microlenses prevent a wavelength of the light provided from the LED from changing as the light is transmitted through the lens.

7. The LED based lamp of claim 1, wherein the plurality of microlenses are shaped to minimize a gap between adjacent microlens.

8. The LED based lamp of claim 1, wherein the plurality of microlenses prevent a yellow ring phenomenon.

9. The LED based lamp of claim 1, wherein the lens includes a hollow part for receiving the LED module therein, and a sloped surface.

10. The LED based lamp of claim 1, wherein the housing comprises a heat sink.

11. A light emitting diode (LED) based lamp comprising:

a housing;

a LED module having at least one LED, the LED module provided in the housing;

a lens for guiding light from the LED module to a defined region, the lens to receive the LED, the lens including a light exit surface; and a plurality of microlenses provided on the light exit surface, wherein the microlens are non-circular shaped to prevent a wavelength of the light from the LED module from changing as light passes through the lens.

12. The LED based lamp of claim 11, wherein a distance between two opposing sides of one of the microlenses is 0.7 mm to 1.2 mm.

13. The LED based lamp of claim 11, wherein at least one of the plurality of microlenses has a hexagonal shape.

14. The LED based lamp as claimed in claim 11, wherein at least one of the plurality of microlenses has a hexagonal dome shape.

15. The LED based lamp of claim 11, wherein a shape of a first one of the microlens is different from a shape of a second one of the microlens.

16. The LED based lamp of claim 11, wherein at least three of the microlenses are in line to line contact.

17. The LED based lamp of claim 11, wherein the plurality of microlenses are shaped to minimize a gap between adjacent microlens.

18. The LED based lamp of claim 11, wherein the plurality of microlenses prevent a yellow ring phenomenon.

19. The LED based lamp of claim 11, wherein the lens includes a hollow part for receiving the LED module therein, and a sloped surface.

20. The LED based lamp of claim 11, wherein the housing comprises a heat sink.

* * * * *